US005373483A

United States Patent [19]

Burke

[11] Patent Number: 5,373,483

[45] Date of Patent: Dec. 13, 1994

[54] CURVILINEAR WIDEBAND, PROJECTED DERIVATIVE-MATCHED, CONTINUOUS APERTURE ACOUSTIC TRANSDUCER

[75] Inventor: Shawn E. Burke, Andover, Mass.

[73] Assignee: The Charles Stark Draper Laboratory, Inc., Cambridge, Mass.

[21] Appl. No.: 159,848

[22] Filed: Dec. 1, 1993

Related U.S. Application Data

[63] Continuation-in-part of Ser. No. 677,799, Mar. 29, 1991, Pat. No. 5,237,542.

[51] Int. Cl.[5] ..... G01S 15/00; H04R 17/00

[52] U.S. Cl. ..... 367/103; 367/119; 367/124; 367/153; 367/157; 310/334; 310/337

[58] Field of Search ..... 367/103, 105, 119, 121, 367/122, 124, 125, 126, 129, 153, 157, 905; 310/322, 334, 337

[56] References Cited

U.S. PATENT DOCUMENTS 4,166,999 9/1979 Brady, III ..... 367/105
4,167,753 9/1979 Lynk ..... 358/140
4,460,841 7/1984 Smith et al. ..... 310/334
5,237,542 8/1993 Burke et al. ..... 367/103

OTHER PUBLICATIONS

"The Monopulse Sonar Concept and Its Realization for AUV Application", Charles Stark Draper Laboratory Report, 1990.

"Wide-band Monopulse Sonar", T. L. Henderson, IEEE Journal of Oceanic Engineering, vol. 14, No. 1, Jan. 1989.

*Primary Examiner*—J. Woodrow Eldred
*Attorney, Agent, or Firm*—Iandiorio & Teska

[57] ABSTRACT

A curvilinear wideband, projected derivative-matched continuous aperture acoustic transducer includes a first curvilinear sensor having a predetermined spatial shading which is constrained to zero at its ends and has amplitude continuity between its ends; and a second curvilinear sensor area having a spatial shading which is the projected spatial derivative of the spatial shading of said first area and which has a discontinuous amplitude at its ends; the first and second spatially shaded areas being superimposed and coextensive along the sensing axis.

15 Claims, 5 Drawing Sheets

CURVILINEAR WIDEBAND, PROJECTED DERIVATIVE-MATCHED, CONTINUOUS APERTURE ACOUSTIC TRANSDUCER

RELATED CASE

This application is a Continuation-in-Part of U.S. patent application Ser. No. 07/677,799, "Wideband, Derivative-Matched Continuous Aperture Acoustic Transducer", filed Mar. 29, 1991, now U.S. Pat. No. 5,237,542 by the same inventor.

FIELD OF INVENTION

This invention relates to a circular wideband, projected derivative-matched continuous aperture acoustic transducer.

BACKGROUND OF INVENTION

Conventional sonar systems traditionally consist of a plurality of discrete transducers aligned in linear, curvilinear, or planar arrays. Directional resolution is accomplished through analog or digital electronics by beam steering. Such systems usually require a large number of discrete transducers and electronics which includes signal conditioning amplifiers and digital computers. These are complex systems which are large, heavy, difficult to maintain and calibrate, expensive, and require significant electrical power.

One recent approach proposes an alternative means for obtaining high resolution without steering using derivative-matched spatially shaded sensing apertures consisting of a number of discrete sensors. However, this implementation introduces directional ambiguities and/or implicit bandwidth limitations to prevent spatial aliasing. In addition, a large number of discrete sensors is required which continues the problem of large size, weight, expense, maintenance and calibration.

More recently in the related case cited above a wideband, derivative-matched, continuous aperture acoustic sensing system was achieved by erecting the derivative-matched shading, physically, in the transducer with two sensor areas, one or which possesses a shading which is the spatial derivative of the other and with the two sensor areas superimposed and coincident along the sensing axis.

Although such derivative-matched transducers work well for generally flat surfaces, many applications require mounting on curved surfaces such as the cylindrical or elliptical surfaces of ships and underwater devices. Often sonobuoy probes and autonomous undersea vehicles (AUV's) have constrained platforms, i.e., limited space for instruments, so there is little room to accommodate "flat" transducers although there is mounting space available on the curved surfaces of such devices.

SUMMARY OF INVENTION

It is therefore an object of this invention to provide an improved curvilinear wideband, projected derivative-matched, continuous aperture acoustic transducer particularly advantageous for sonar systems and other devices having curved mounting surfaces.

It is a further object of this invention to provide such an improved curvilinear wideband, projected derivative-matched, continuous aperture acoustic transducer which enjoys derivative matching advantages without the attendant need for a large number of discrete sensors and associated electronics.

It is a further object of this invention to provide such an improved curvilinear wideband, projected derivative-matched, continuous aperture acoustic transducer which has wideband capability without spatial aliasing.

It is a further object of this invention to provide such an improved curvilinear wideband, projected derivative-matched, continuous aperture acoustic transducer which eliminates directional ambiguities occurring with discrete sensor elements.

It is a further object of this invention to provide such an improved curvilinear wideband, projected derivative-matched, continuous aperture acoustic transcucer which is smaller, lighter, less expensive, and easier to calibrate and maintain.

It is a further object of this invention to provide such an improved curvilinear wideband, projected derivative-matched, continuous aperture acoustic transducer which is applicable to cylindrical, elliptical and other curved surfaces.

The invention results from the realization that a curvilinear continuous aperture acoustic transducer may be made for application to any arbitrary curved surface by having a first curvilinear sensor area with a predetermined spatial shading that is constrained to zero at its ends and has amplitude continuity between those ends, and a second curvilinear sensor area having a spatial shading which is a projected spatial derivative of the spatial shading of the first area and which has a discontinuous amplitude at its ends, with the two areas being superimposed and coextensive along their sensing axis.

This invention features a curvilinear wideband, projected derivative-matched continuous aperture acoustic transducer having a first curvilinear sensor area with a predetermined spatial shading that is constrained to zero at its ends and has amplitude continuity between its ends. A second curvilinear sensor has a spatial shading which is the projected spatial derivative of the spatial shading in the first area and has a discontinuous amplitude at its ends. The first and second spatially shaded areas are superimposed and coextensive along the sensing axis.

In a preferred embodiment there may be means for combining the output of the first sensor area with the output of the second sensor area to obtain a signal proportional to the cosine of the angle of incidence of an acoustic wavefront. One of the sensor areas may include at least a portion of the other sensor area. One of the sensor areas may include all of tile other sensor area. The first sensor area may include the second sensor area. The shape of the second sensor area may be the projected spatial derivative of the shape of the first sensor area. The spatially varying sensitivity characteristic of the second sensor area may be the projected spatial derivative of tile spatially varying sensitivity characteristic of the first sensor area. The transducer may include a pair of electrodes and a sensor medium between them. The first and second sensor areas may be defined in and contained in the sensor medium. The first and second sensor areas may be defined by an electrode and contained in the sensor medium. The transducer may include a first sensor medium and a second sensor medium and electrode means for sensing the output of the sensor mediums. The first sensor medium may include a first sensor area and the second sensor medium may include a second sensor area. The first sensor area may be rhombic and the second sensor area may be generally rectangular with curved sides and flared ends. The first sensor area may be triangular and the second sensor area may be generally rectangular with one curved side, one straight side and flared ends. The means for combining may include means for integrating and scaling the output of the second sensor and means for dividing the output of the first sensor by the output of the means for integrating and scaling.

DISCLOSURE OF PREFERRED EMBODIMENT

Other objects, features and advantages will occur to those skilled in the art from the following description of a preferred embodiment and the accompanying drawings, in which.

Figure 11:
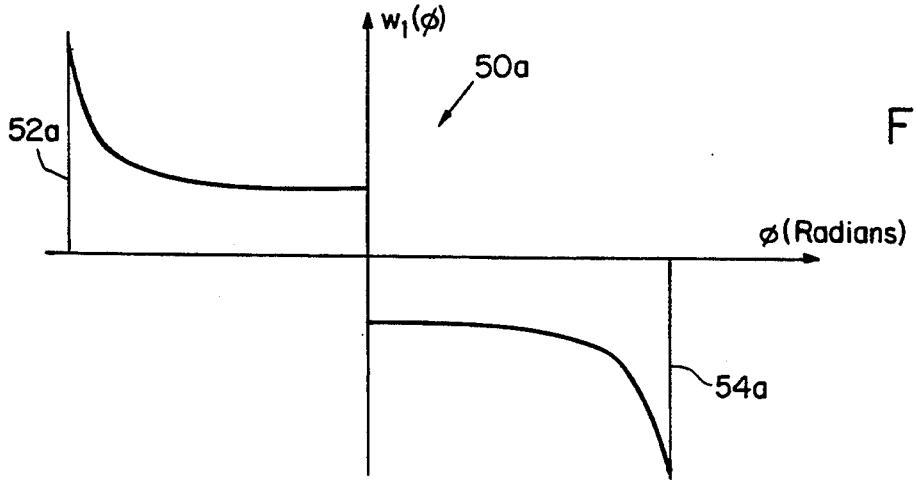
Figure 12:
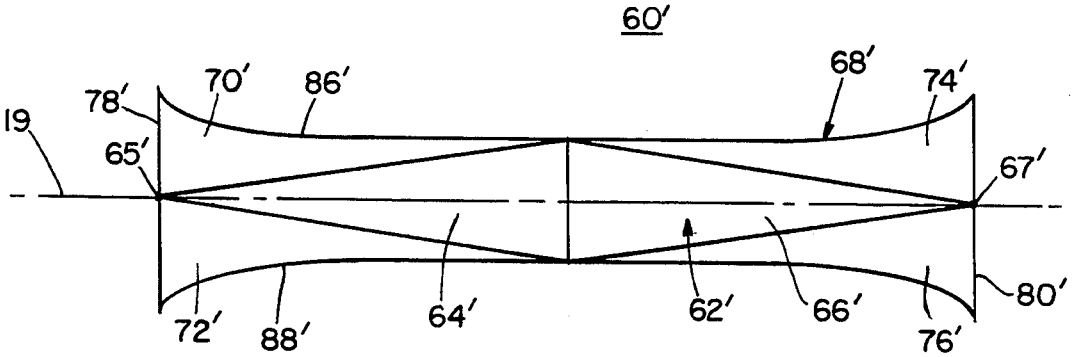
Figure 13:
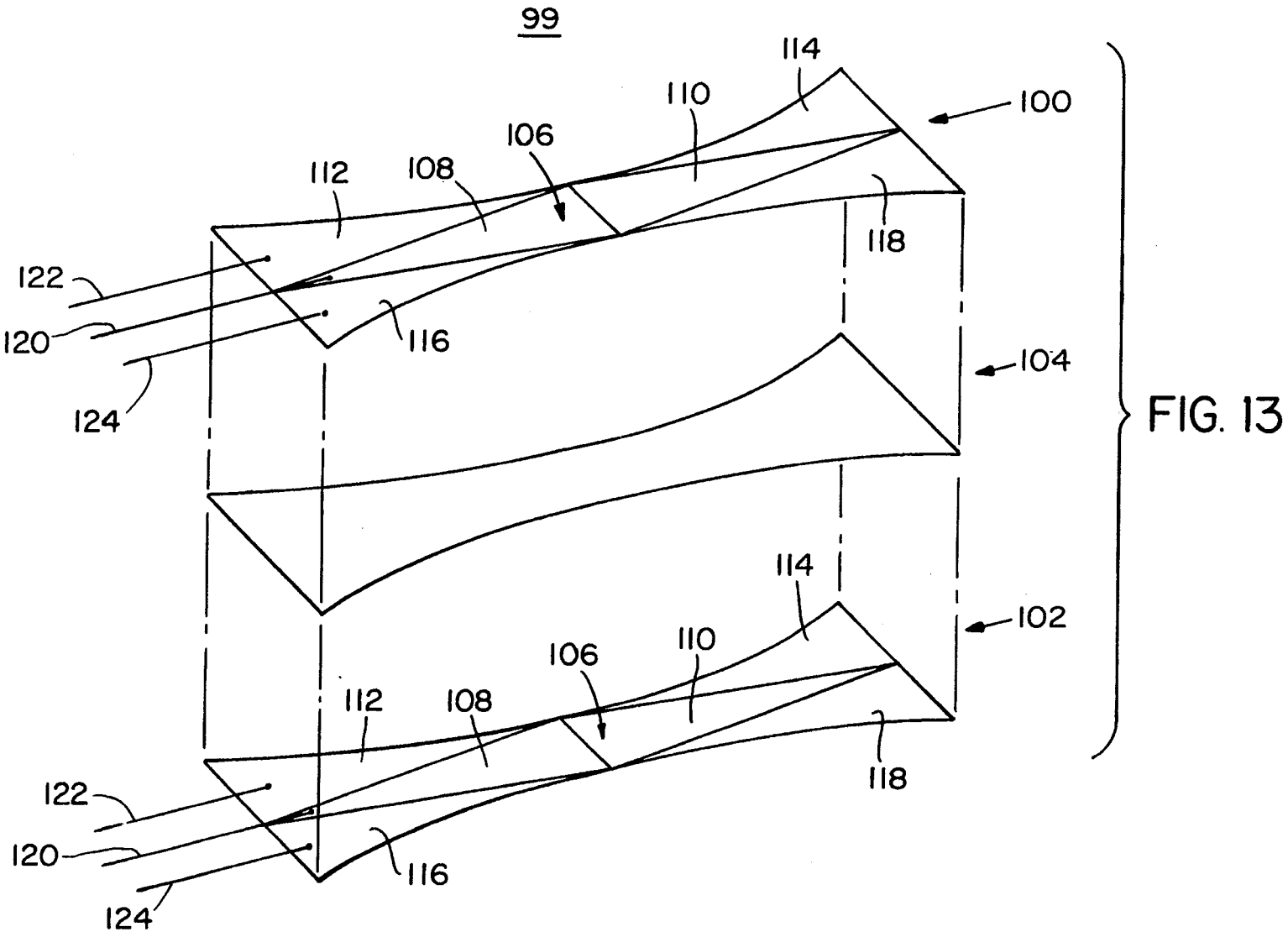

FIG. 11 is a graphical illustration of the aperture shading $w_1(\phi)$ for an elliptical array; and FIG. 12 is a curvilinear wideband, projected derivative-matched, continuous aperture acoustic transducer electrode pattern according to this invention for an elliptical array; and FIG. 13 is a schematic perspective view of a curvilinear wideband, projected derivative-matched, continuous aperture acoustic transducer electrode pattern according to this invention.

Figure 1:
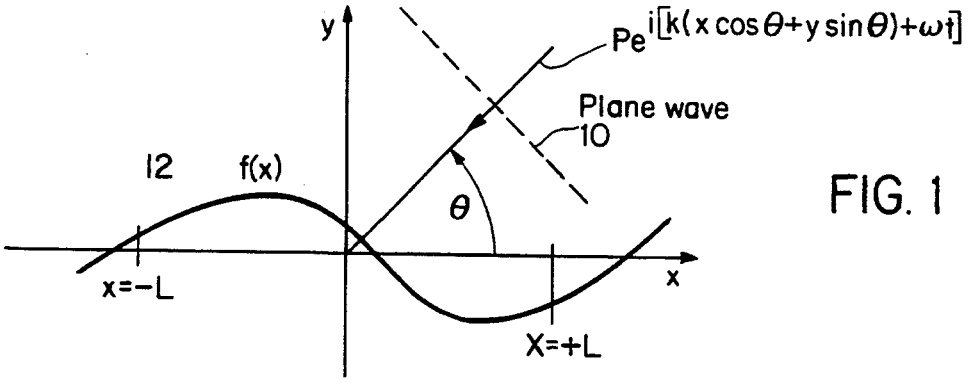
FIG. 1 is a graphical illustration of the oblique incidence geometry for a general curvilinear array.
Figure 2:
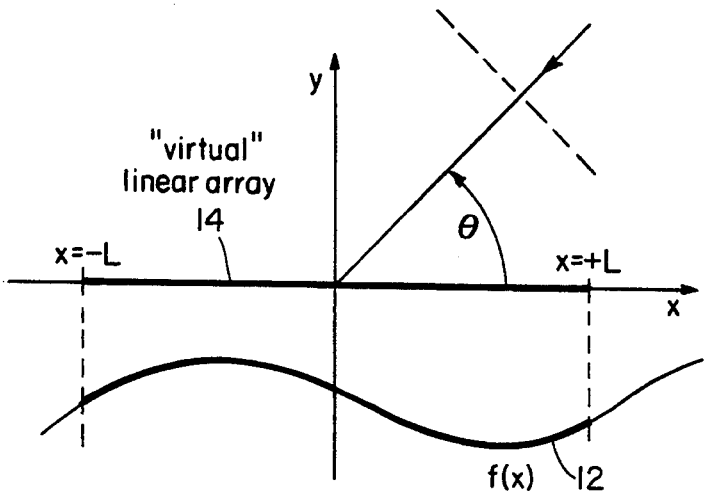
FIG. 2 is a graphical representation of a virtual linear array superimposed of a curvilinear surface.

There is shown in FIG. 1 an oblique incidence geometry for a general curvilinear acoustic transducer array which depicts the problem of inferring the angle of incidence $\theta$ of a sound field indicated as plane wave 10 across an arbitrary curvilinear surface 12 which extends frown limit $x=-L$ to $x=+L$ and typically has a radius of curvature other than infinity: that is, it is not straight or flat. In order to construct a distributed sensor such as one made of piezoelectric material, polyvinyldine fluoride, voided polyvinyldine fluoride, copolymer ($PVF_2/PVF_3$), or other suitable mediums, according to this invention, a virtual linear array 14, FIG. 2, is superimposed on curvilinear surface 12, which is the projection of curvilinear surface 12 onto a straight or flat surface. And in order to employ shaded distributed sensors on the curved surface, which sensors are related by a projected derivatives, the virtual linear array 14 is projected back onto the curvilinear surface 12 in accordance with the geographic transformation:

$$w_1(x) = u\left\{\frac{w_0'(x)}{u + ik\sin\theta f'(x)} - \frac{ik\sin\theta w_0(x)f''(x)}{[u + ik\sin\theta f'(x)]^2}\right\} \quad (1)$$

where $w_0(x)$ is the shading and $w_1(x)$ is the projected derivative of the shading along x; u is equal to $ik\cos\theta$, i is the imaginary number; k is the wave number; and f(x) defines the curvilinear surface; and $\theta$ is the angle of incidence of the sound field.

Figure 3:
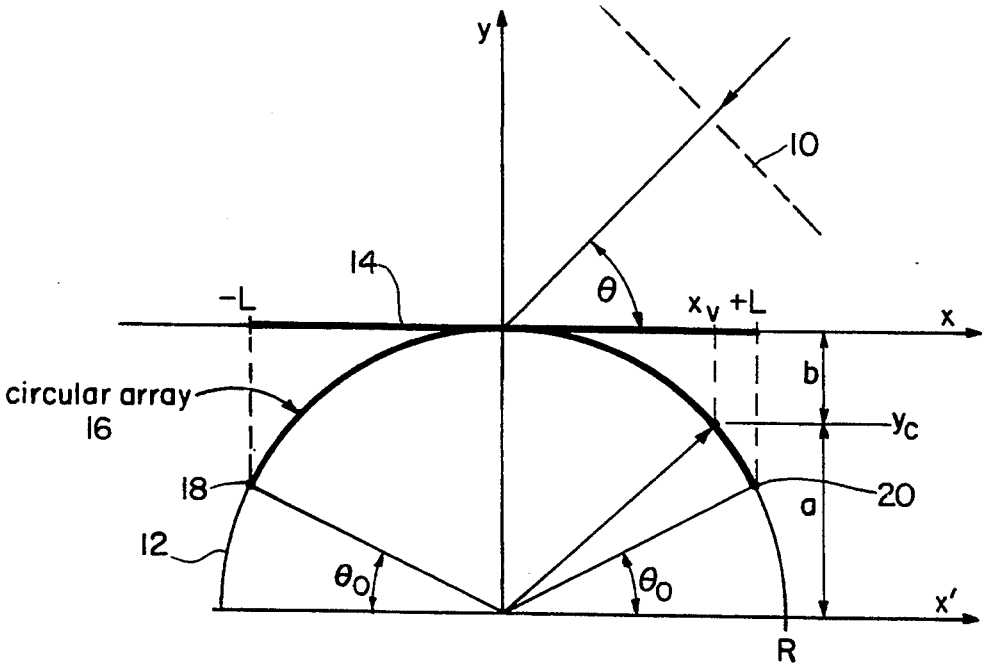
FIG. 3 is a graphical illustration of the oblique incidence geometry for a circular array.

In one case where the curvilinear array 12 is a circle having a radius R, FIG. 3, each point on a transducer array 16 is defined by radius R and a particular value of angle $\phi$. The limits 18 and 20 of array 16 are defined by radius R and the angles $\phi_0$. Points on array 16 may also be defined in x,y coordinates as indicated at $x_v$ equal to the x distance along the virtual linear array, and $y_c$ which indicates the y separation distance along the curvilinear array. The aperture shading $w_0$, FIG. 4, in this embodiment is shown as a triangular waveform 30 having amplitude continuity between its ends 32 and 34 as indicated by the continuous slopes 36 and 38 which are constrained to zero or vanish at end points 32 and 34. The slope is discontinuous as indicated at point 40 where the sign of the slopes 36, 38 changes direction. The projected derivative of shading 30, $w_1$, is shown by shading 50, FIG. 5, which has discontinuous amplitude at each of its ends 52 and 54. The expression of transformation between shading 30 and the projected derivative-matched shading 50 is expressed as:

$$w_1(\phi) = \frac{-1}{R}\ \frac{d}{d(\cos\phi)}\ [w_0(\phi)] \quad (2)$$

Figure 4:
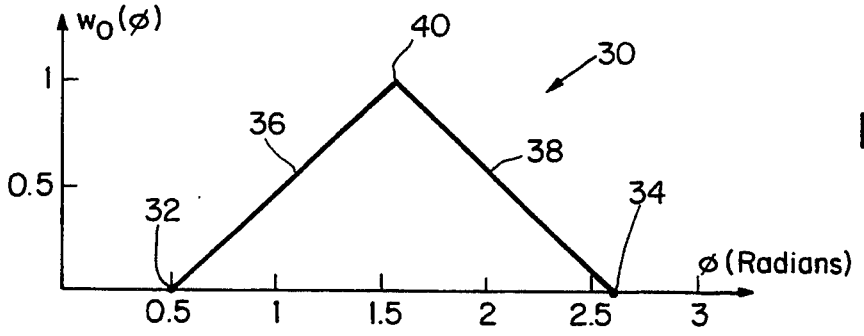
FIG. 4 is a graphical illustration of the aperture shading $w_0(\phi)$ for a circular array.
Figure 5:
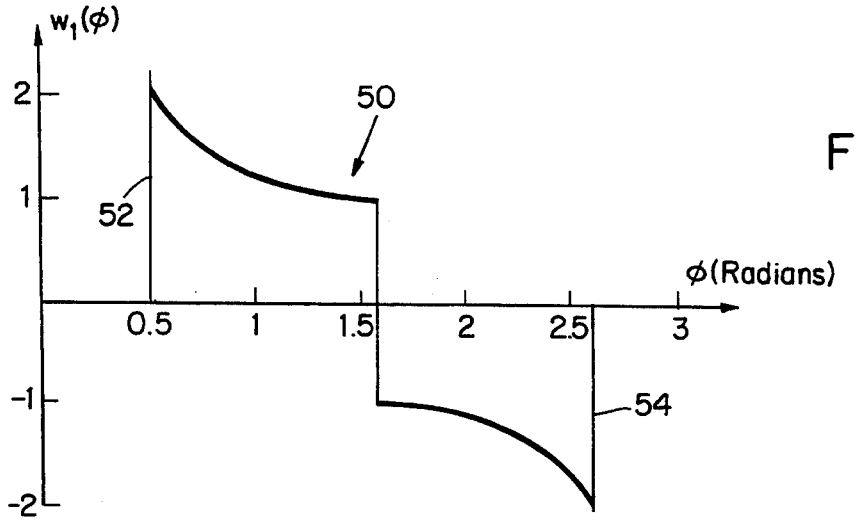
FIG. 5 is a graphical illustration of the aperture shading $w_1(\phi)$ for a circular array.
Figure 6:
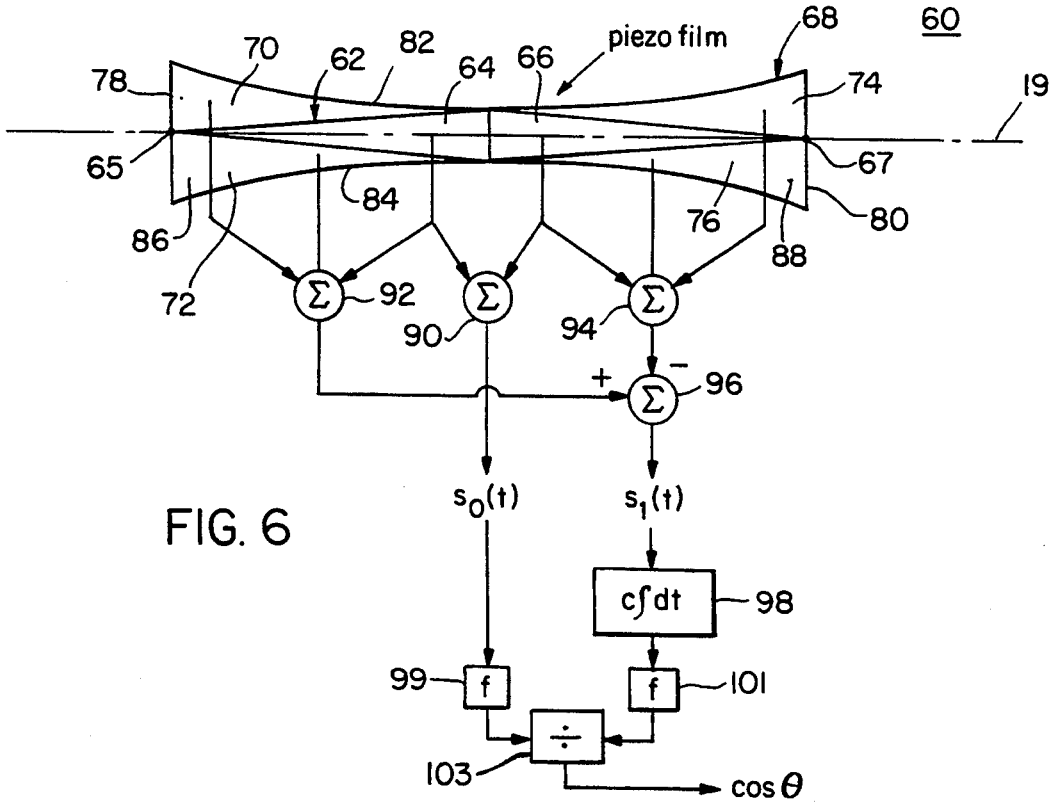
FIG. 6 is a schematic plan view of a projected transducer electrode pattern for a circular array using rhombic and generally rectangular areas according to this invention.
Figure 7:
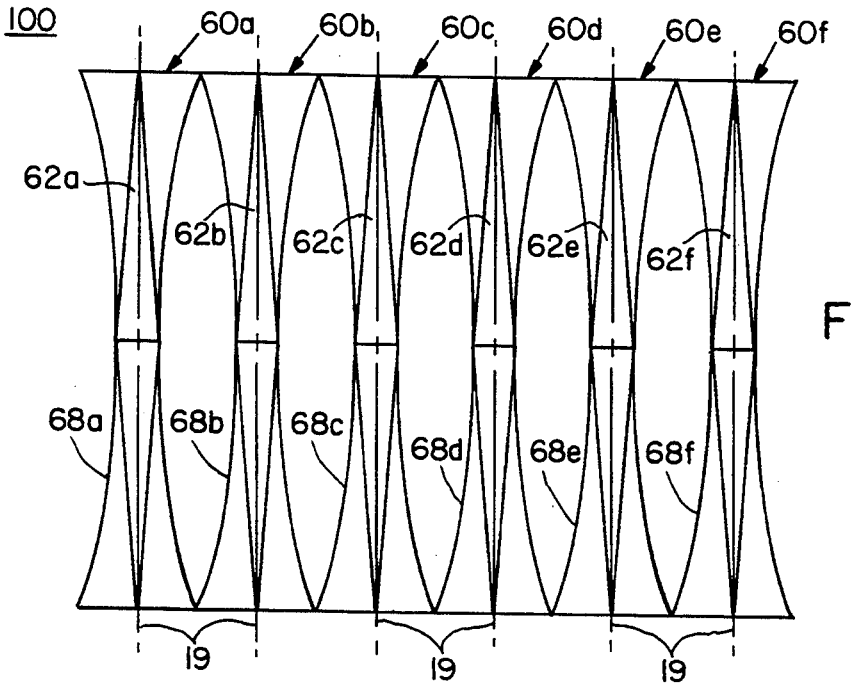
FIG. 7 is a composite transducer electrode pattern formed from a plurality of transducers as shown in FIG. 6.

One implementation of the device is transducer 60, FIG. 6, which includes a first rhombic shaped sensor area 62 including two segments 64 and 66 having vanishing end points 65, 67 which correspond to vanishing end points 32, 34, FIG. 4, and a generally rectangular sensor area 68 which is formed from the two rhombic areas 64 and 66 plus two pairs of end segments 70, 72 and 74, 76. Sensor 68 demonstrates discontinuous end points 78 and 80 with curved sides 82 and 84 and flared ends portions 86 and 88 enclosing an area defined by eq (2). Sensor areas 62 and 68 are aligned along longitudinal axis 19. The outputs from sensor areas 62 an 68 are separately summed. The output from rhombic sensor area 62 is derived from segments 64, 66 and combined in summer 90 to provide the output so(t). The output of the rectangular sensor area 68 is derived from segments 70, 72 and 64 combined in summer 92 and segments 74,76 and 66 which are combined in summer 94. The outputs of summers 92 and 94 are then combined in summer 96 to provide the output signal $s_1(t)$. The outputs $S_0(t)$ and $S_1(t)$ from summers 90 and 96, respectively, may pass through signal conditioning filter 99, 101 and combined in divider 103 to filter out extraneous noise as is well known. Rhombic sensor area 62 and rectangular sensor area 68 constitute a set of projected derivative matched apertures aligned along the sensing axis 19. By simply dividing $s_1(t)$ by $s_0(t)$ temporally integrating and multiplying by the speed of sound in the acoustic medium, the cosine of the angle of incidence of an acoustic wave is determined from which the direction of the wave is obvious. This is accomplished by integrating $s_1(t)$ and scaling it by the speed of sound c in integration circuit 98 and then dividing the result by $s_0(t)$ in divider 100 to obtain cosine $\theta$. A number of such sensors 60*a–f*, FIG.7, may be combined to form a larger sensor device 100.

Figure 8:
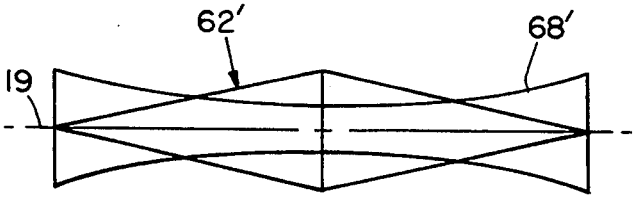
FIG. 8 is an alternative embodiment of a transducer electrode pattern for a circular array according to this invention.

Although thus far the sensor portion 62 corresponding to shading waveform 30. FIG. 4, is contained inside of sensor portion 68 corresponding to shading waveform 50, FIG. 5, this is not a necessary limitation of the invention. Sensor portion 62', FIG. 8, may be enlarged so that it extends beyond the confines of sensor portion 68'.

Figure 9:
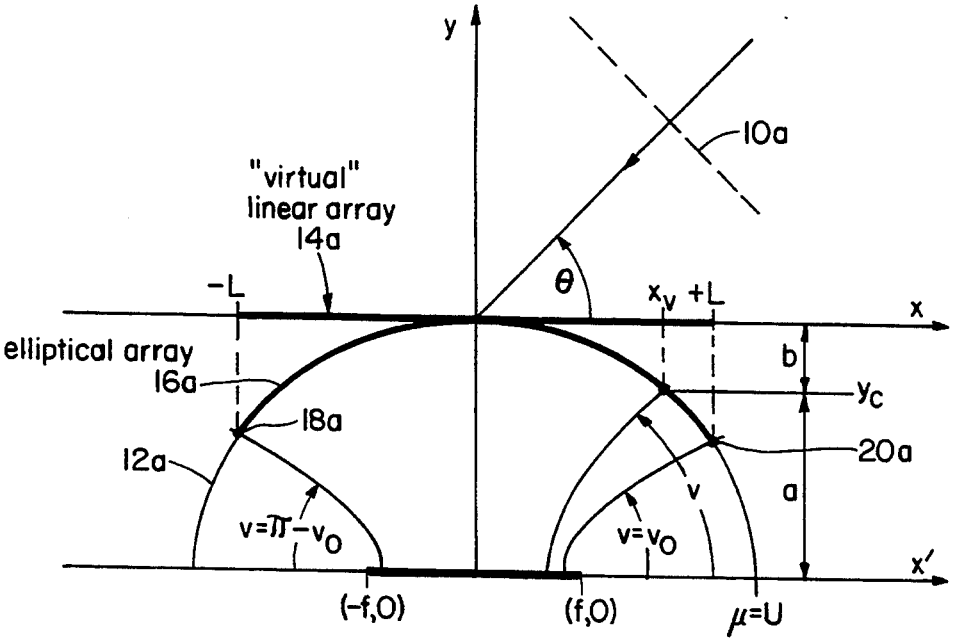
FIG. 9 is a graphical illustration of oblique incidence geometry for an elliptical array.
Figure 10:
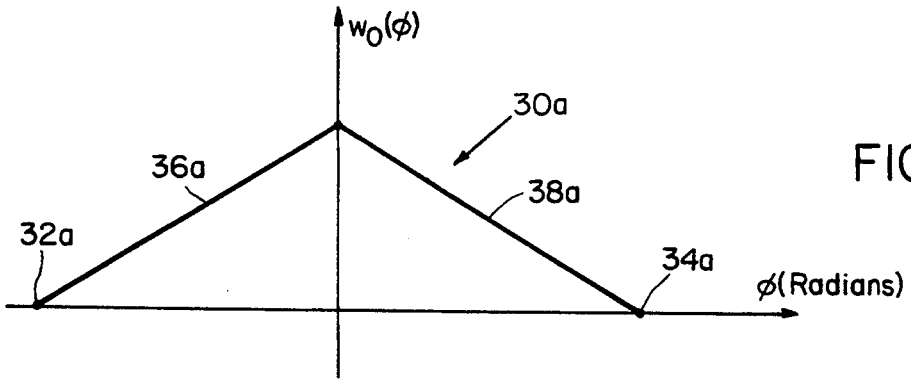
FIG. 10 is a graphical illustration of the aperture shading $w_0(\phi)$ for an elliptical array.

Although the example in FIGS. 3–8 relate to a curvilinear surface of the applique of the sensors on a curvilinear surface which is circular, this is not a necessary limitation of the invention as the sensor arrays may be appliqued on any curvilinear surface defined by a polynomial expression, e.g., ellipses, hyperbolas, parabolas, splines, and even flat surfaces where the curvilinear radius is infinite. For example, FIG. 9 depicts the oblique incidence geometry for an elliptical array where the elliptical sensor 16*a* is defined on elliptical surface 12*a* by end points or limits 18*a*, 20*a*. Points on elliptical surface 12*a* are defined by the elliptical angle $\nu$ and radius $\mu$. In the particular case in FIG. 9, radius $\mu$ has a defined value U along the array and the angles $\nu$ of limits 18*a* and 20*a* are defined by the angle $\nu=\pi-\nu_0$ and $\nu=\nu_0$. The shading $w_0$, FIG. 10, for elliptical sensor 16*a* is depicted by function 30*a* having slopes 36*a* and 38*a* and ends 32*a* and 34*a* similar to those shown in FIG. 4. The projected derivative of shading 30*a*, function 50*a*, FIG. 11, is similar in appearance to shading 50, FIG. 5 but has a somewhat different curvature, with discontinuous ends 52*a* and 54*a* but with slightly different curvature. The resulting sensor 60', FIG. 12, has the same generally rectangular shaped sensor portion 68' and rhombic shaped portion 62' as in FIG. 6. Rhombic portion 62' has vanishing ends 65' and 67' and portion 68' has similar discontinuous ends 78' and 80' with curved sides 86' and 88'.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A curvilinear wideband, projected derivative-matched continuous aperture acoustic transducer, comprising:

a first curvilinear sensor area having a predetermined spatial shading which is constrained to zero at its ends and has amplitude continuity between its ends;

a second curvilinear sensor area having a spatial shading which is the projected spatial derivative of the spatial shading of said first area and which has a discontinuous amplitude at its ends; said first and second spatially shaded areas being superimposed and coextensive along the sensing axis.

2. The curvilinear wideband, projected derivative-matched continuous aperture transducer of claim 1 further including means for combining the output of said first sensor area with the output of said second sensor area to obtain a signal proportional to the cosine of the angle of incidence of an acoustic wavefront.

3. The curvilinear wideband, projected derivative-matched continuous aperture transducer of claim 1 in which one of said sensor areas includes at least a portion of the other sensor area.

4. The curvilinear wideband, projected derivative-matched continuous aperture transducer of claim 1 in which one of said sensor areas includes all of the other sensor area.

5. The curvilinear wideband, projected derivative-matched continuous aperture transducer of claim 1 in which said first sensor area includes said second sensor area.

6. The curvilinear wideband, projected derivative-matched continuous aperture transducer of claim 1 in which the shape of said second sensor area is the projected spatial derivative of the shape of said first sensor area.

7. The curvilinear wideband, projected derivative-matched continuous aperture transducer of claim 1 in which the spatially varying sensitivity characteristic of said second sensor area is the projected spatial derivative of the spatially varying sensitivity characteristic of said first sensor area.

8. The curvilinear wideband, projected derivative-matched continuous aperture transducer of claim 1 in which said transducer includes a pair of electrodes and a sensor medium between them.

9. The curvilinear wideband, projected derivative-matched continuous aperture transducer of claim 8 in which said first and second sensor areas are defined in and contained in said sensor medium.

10. The curvilinear wideband, projected derivative-matched continuous aperture transducer of claim 9 in which said first and second sensor areas are defined by a said electrode and contained in said sensor medium.

11. The curvilinear wideband, projected derivative-matched continuous aperture transducer of claim 1 in which said transducer includes a first sensor medium and a second sensor medium and electrode means for sensing the output of said sensor mediums.

12. The curvilinear wideband, projected derivative-matched continuous aperture transducer of claim 11 in which said first sensor medium includes said first sensor area and said second sensor medium includes said second sensor area.

13. The curvilinear wideband, projected derivative-matched continuous aperture transducer of claim 1 in which said first sensor area is rhombic and said second sensor area is generally rectangular with curved sides and flared ends.

14. The curvilinear wideband, projected derivative-matched continuous aperture transducer of claim 1 in which said first sensor area is triangular and said second sensor area is generally rectangular with one curved side, one straight side and flared ends.

15. The curvilinear wideband, projected derivative-matched continuous aperture transducer of claim 2 in which said means for combining includes means for integrating, filtering, and scaling the output of said second sensor, and means for dividing the output of said first sensor by the output of said means for integrating, filtering, and scaling.

* * * * *